United States Patent [19]

Russomanno et al.

[11] Patent Number: 5,054,611

[45] Date of Patent: Oct. 8, 1991

[54] LUNCH BOX HAVING SELECTABLE DISPLAYS

[76] Inventors: Anthony Russomanno; Gary Russomanno, both of 1996 Rte. 27, Edison, N.J. 08817

[21] Appl. No.: 498,730

[22] Filed: Mar. 26, 1990

[51] Int. Cl.[5] ..... B65D 81/36

[52] U.S. Cl. ..... 206/45.28; 206/542; 206/457; 40/312

[58] Field of Search ..... 206/45.14, 45.15, 45.28, 206/541, 542, 457, 37, 1.5; 40/649, 611, 642, 312

[56] References Cited

U.S. PATENT DOCUMENTS

| | | | |
|---|---|---|---|
| 598,801 | 2/1898 | Minter | 206/541 X |
| 2,279,893 | 4/1942 | Ross et al. | 206/457 X |
| 2,321,703 | 6/1943 | Rivard | 206/541 |
| 3,739,975 | 6/1973 | Davidow | 206/457 X |
| 3,777,418 | 12/1973 | Cooper | 206/542 |
| 3,867,971 | 2/1975 | Hazan | 206/457 X |
| 4,216,862 | 8/1980 | Daenen | 206/541 |
| 4,666,042 | 5/1987 | Dlott et al. | 206/542 |
| 4,936,462 | 6/1990 | Yuen | 206/542 |

*Primary Examiner*—Paul T. Sewell
*Assistant Examiner*—Jacob K. Ackun, Jr.
*Attorney, Agent, or Firm*—Arthur L. Plevy

[57] ABSTRACT

A device for decorating a carrying box which includes representational members carried within the box selectively deployable through openings therein. In the retracted position, only a gripping tab projects from the opening and the fanciful representational graphic component is not visible. The graphic component is deployed by pulling the visible tab. A plurality of matched pairs of graphic components are stored within the box, each pair bearing a portion of an identifiable form. Matched pairs are projected out opposing sides of the box conveying the impression of a continuity within the box of the form represented by the visible portions. A lock is provided for retaining the graphics in both the deployed and retracted positions.

15 Claims, 2 Drawing Sheets

LUNCH BOX HAVING SELECTABLE DISPLAYS

BACKGROUND OF THE INVENTION

The present invention relates to a carrying box and more particularly to a lunch box incorporating selectable displays.

Lunch boxes have been used by millions of children over the years. Little more than a simple box constructed from metal or plastic having a hinged opening lid, a latch for maintaining closure, and a handle to facilitate carrying, the lunch box is the daily companion of many children, a tidy parcel symbolic of a greater body of care, carrying as it does, gifts of sustenance lovingly bestowed. Knowing, however, that man does not by bread alone live, many efforts have been made over the years to enhance the noble utilitarian lunch box with aesthetic and notional improvements to provide food for the imagination and the fancy, as well as for the body. Lunch boxes have been designed having additional fanciful functions over and above their principle function of food containment, e.g., for receiving writing and artwork thereupon (U.S. Pat. No. 3,777,418 to Cooper), for containing games, and for converting into toys (U.S. Pat. No. 4,666,042 to Dlott et al.). Lunch boxes have also commonly been employed as a canvas for bearing the images of popular media personalities and fictional characters and in this capacity serve to publicly state the preferences and interests of the carrier. Although publically expressive indicia have been used on lunch boxes, it is not typically selectable as to use or non-use. Further, while several known lunch box designs are whimsical, there are none which convey, depict and embody a situation and a concept which amounts to a joke that appeals to the sense of humour.

SUMMARY OF THE INVENTION

The present invention provides a lunch box for selectively conveying a whimsical message to appeal to the humor and imagination of children. Embodiments of this invention include at least one representational member bearing a fanciful graphic image or shape. The representational member is carried within the lunch box and is selectively deployable to a display position via an opening in the box.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
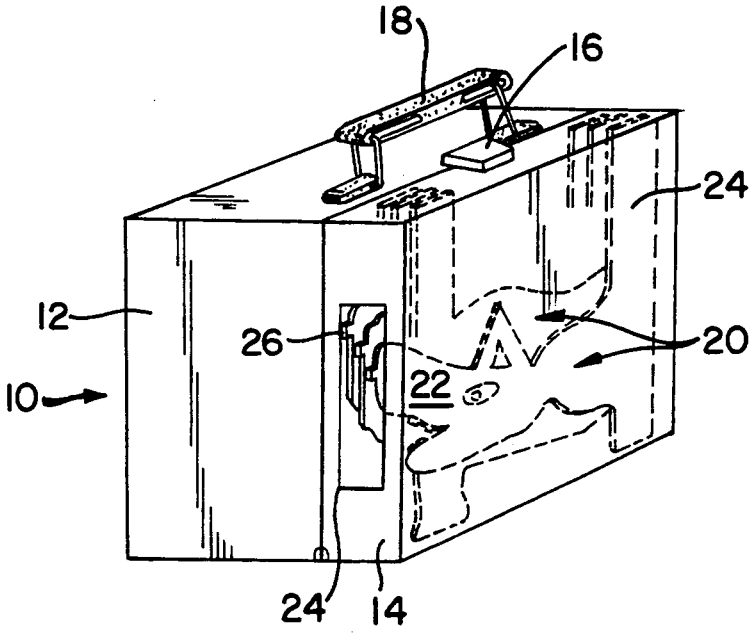
FIG. 1 is a perspective, partially phantom view of a lunch box in accordance with the present invention prior to deploying the graphic components thereof.

Referring to FIG. 1 there is shown a lunch box 10 having an internally hollow box portion 12 with a mating, opposed lid 14 hingedly connected along an edge thereof and releasably kept in a closed position by a latch mechanism 16. A handle 18 is provided to assist in carrying the box. In the embodiment depicted, the lid 14 is smaller in depth than the box portion 12, but any relative dimensioning of the lid 14 to the box portion 12 is contemplated by the present invention, including a pair of equally sized clam shell-like halves. The lid 14 contains within it at least one representational member 20, a portion of which supports a graphic depiction or display 22 of a whimsical nature. The display 22 portion of the representational members 20 are projectible through slots 23 within the lid. The display 22 shown is a placard having a carved periphery which embodies the graphic image, but it need not have a graphic profile and could instead be a regular shape such as a rectangle, the graphic message being borne by, e.g., a label affixed thereto. Similarly, the display 22 need not be a flat, placard shaped member as shown and could instead be representational in all three dimensions. The representational member 20 includes a carrier portion 24 for supporting and retaining the display 22 in association with the box. The representational member 20 can be formed from any semi-rigid material, such as cardboard, thermoplastic or composite construction, the principle requirements being modest cost and safety, i.e., the projectible display 22 cannot have sharp edges or be otherwise unyielding when subjected to unintended uses such as being fallen upon or dashed against a playmate. Preferably, the representational members 20 or at least the display portions 22 are manufactured from a plastic or rubber which can deform easily but regain its shape so as to prevent breakage when subjected to hard use. A gripping tab 26 is provided at an extreme edge of the display 22 to facilitate pulling it from its retracted position from within the box to a display position external thereto. The display 22 can depict any desired fanciful entity so long as its dimension from top to bottom does not exceed that of the slot 23. A plurality of representational members 20 may be stored within the box for deployment at the discretion of the child.

Figure 2:
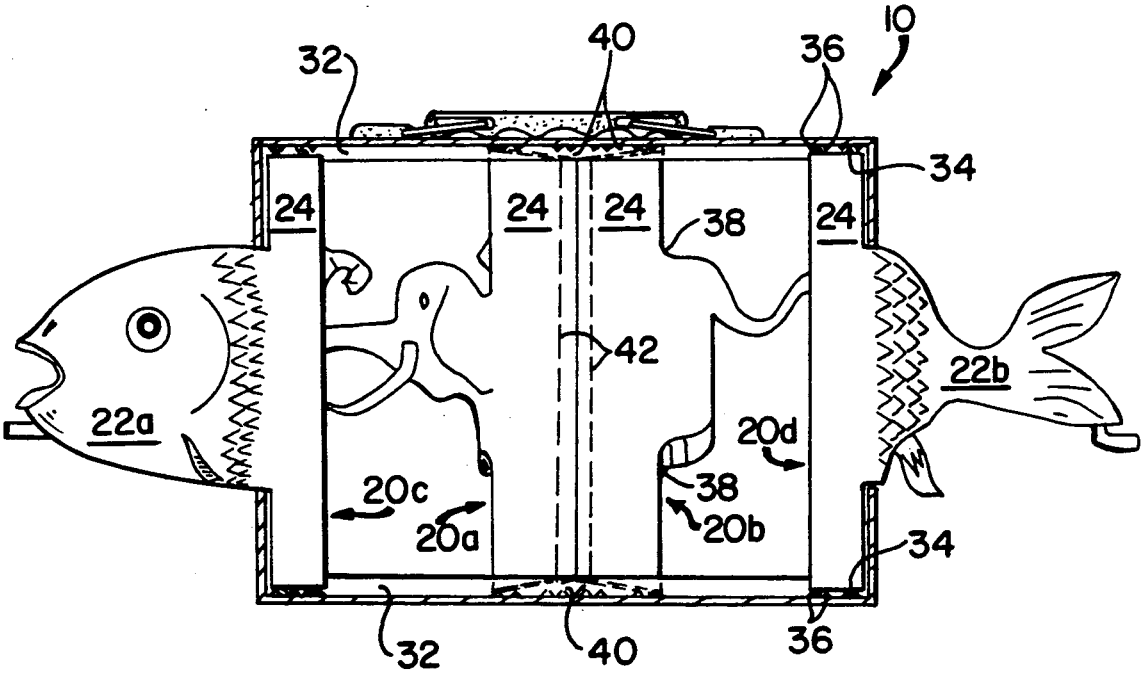
FIG. 2 is a side cross-sectional view in elevation of a lunch box in accordance with the present invention showing one set of graphic components deployed and another set retracted within the lunch box.

Referring now to FIG. 2 a cross-sectional view of the box 10 illustrates two pairs of representational members with differing display enhancements, 20*a* and *b* and 20*c* and *d*, 20*a, b* being in the retracted position and 20*c, d* being in the deployed position. The pairs are matched such that one end of the respective figurative entity protrudes from one side of the box when deployed and the opposite end projects from the other side. For example, the fish head display 22*a* projects out to the left while the fish tail display 22*b* projects to the right. This display arrangement exemplifies an element of the humourous nature of the device in that it constitutes a sight gag which suggests that the carrier bears, e.g., a fish in his or her lunch box, and further, that the fish is so large that it is not contained wholly within the box and thus must project from either side (the imagination of the viewer providing the image of the unseen morphology). Other animals, vegetables or inanimate objects may be depicted on the display portions and similarly amount to a sight gag or just an interesting decoration that tickles the fancy. Unlike the embodiment depicted in FIG. 1, the representational members in FIG. 2 are containable within half the width of the box and therefore may abut one another within the box as the elephant representational members 20*a, b* do. In the embodiment shown, the carrier portion 24 is "T" shaped, either side of the top of the "T" riding in slots 32 provided at the top and bottom of the box. Locking detents 34 are provided at the extreme ends of the "T" top to lock the representational members in either the deployed or retracted position as desired. The detents 34 correspond to and cooperate with detent receivers 36 a projecting from the box interior surface for locking the representational members 20 in the retracted position and 36*b* for locking the representational members 20 in the deployed position. The lunch box 10 is preferable formed from a relatively flexible thermoplastic or sheet metal that permits the deformation of the detent receivers 36. Alternatively, the carrier portion 24 may be formed of material sufficiently flexible to permit detent operation. An alternate locking method is to provide lands 38 for jamming into the slot 23 periphery when the display 22 is deployed and converging ramps 40 into which the carrier portion 24 jams when the representational member 20 is in the retracted position. A further alternative method for locking the representational members 20 in the retracted position is to provide the internal edges of the carrier portions distal to the display 22 with mating tapers or with a mating tenon and mortise joint which would provide an interlocking friction fit and are depicted schematically by dashed lines 42.

Figure 3:
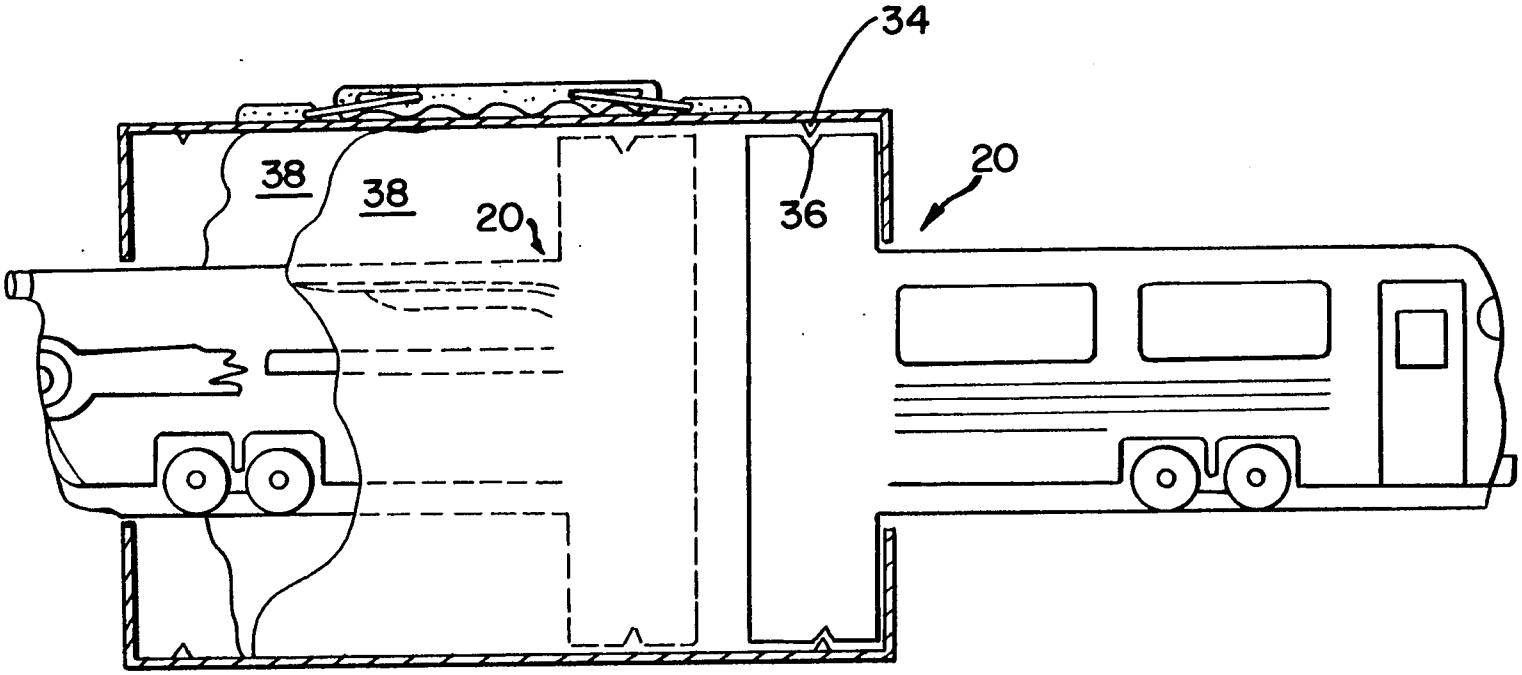
FIG. 3 is a side cross-sectional view in elevation of a lunch box in accordance with the present invention with an alternative graphic component set partially deployed.

In the embodiment depicted in FIG. 3, the representational members 20 overlap when retracted. A set of interleaved spacer sheets 38 are sandwiched between the representational members 20 and serve the same function as the tracks 32 of the previous embodiment, that is, they retain the representational members 20 in alignment with the slot 23 and, in this embodiment, relative to one another in an ordered laminate.

Each of the embodiments shown can be provided as a retrofit to an existing lunchbox design by manufacturing a discrete assembly housing the representational members which is fastened to an existing lunchbox by gluing or other conventional means. Although only lunch boxes have been discussed as the medium in which the present invention is practiced, any similar box or container could be so enhanced.

It should be understood that the embodiments described herein are merely exemplary and that a person skilled in the art may make many variations and modifications without departing from the spirit and scope of the invention as defined in the appended claims.

We claim:

1. A device for decorating a carrying box comprising:

a) at least one pair of representational members contained within said box, a portion of each of said representational members being selectively deployable external to said box and selectively retractable into said box, a first representational member of said pair telescoping through a first opening in a side of said box and a second representational member of said pair telescoping through a second opening in said box disposed opposite to said first opening, said representational members deploying in opposite directions, said deployable portion of said first representational member representing a part of an identifiable form, said deployable portion of said second representational member representing another part of said identifiable form, each of said representational members of said pair including retainer means disposed distal to said deployable portion for preventing said representational member from being withdrawn from said box and gripping means for gripping said representational member, said representational members being deployable by a user gripping said gripping means with the fingers and pulling a selected said representational member through said opening until said retainer means engages said box internally and prevents further deployment;

(b) alignment means internal to said box for maintaining said representational members in alignment with said openings; and (c) lock means for releasably locking said representational members in a retracted position.

2. The device of claim 1, wherein said deployable portion of said representational members is flat and plate-like with a peripheral shape at least partially expressing a graphic content corresponding to said identifiable form.

3. The device of claim 1, wherein said deployable portion of said representational members includes indicia applied to at least one surface thereof.

4. The device of claim 2, wherein said alignment means includes tracks in which said representational members glide.

5. The device of claim 2, wherein said alignment means includes a film interposed between successive said representational members.

6. The device of claim 5, wherein the length of each of said representational members in the direction of deployment approximates the width of said box measured along a line between said openings.

7. The device of claim 4, wherein the length of each of said representational members in the direction of deployment approximates half the width of said box measured along a line between said openings.

8. The device of claim 7, wherein said representational members abut one another internally of said box when said members are retracted within said box.

9. The device of claim 6, wherein said representational members overlap one another when retracted within said box.

10. The device of claim 2, further comprising additional lock means for releasably locking said representational members in a deployed position.

11. The device of claim 10, wherein said lock means includes a detent protruding from each of said representational members and detent receivers formed in an internal surface of said box for receiving said detents and releasably locking said representational members in a retracted position, and wherein said additional lock means includes an additional detent protruding from each of said representational members and additional detent receivers formed in an internal surface of said box for releasably locking said representational members in a deployed position.

12. The device of claim 10, wherein said lock means includes a detent receiver formed in a surface of each of said representational members for receiving a detent projecting from an internal surface of said box for releasably locking said representational members in a retracted position, and wherein said additional lock means includes an additional detent receiver formed in a surface of each of said representational members for receiving an additional detent projecting from an internal surface of said box for releasably locking said representational members in a deployed position.

13. The device of claim 10, wherein said representational members are selectively locked in a deployed position by jamming in said openings and are selectively locked in a retracted position by jamming on a converging internal surface of said box.

14. The device of claim 10, wherein said representational members are selectively locked in a deployed position by jamming in said openings, and are selectively locked in a retracted position by the jamming of mating lock means disposed on said first representational member and said second representational member distal to said deployable portion, when said first representational member and said second representational member are in the retracted position.

15. The device of claim 2, further including a plurality of pairs of said representational members and said additional representational members.

* * * * *